US005125810A

United States Patent [19]

Suefuji et al.

[11] Patent Number: 5,125,810

[45] Date of Patent: Jun. 30, 1992

[54] SCROLL COMPRESSOR WITH A STATIONARY AND ORBITING MEMBER OF DIFFERENT MATERIAL

[75] Inventors: Kazutaka Suefuji, Shimizu; Tetsuya Arata, Sakai; Yoshiro Ibaraki, Tsukuba; Masao Shiibayashi, Shimizu; Jyoji Okamoto, Shizuoka, all of Japan

[73] Assignee: Hitachi, Ltd., Tokyo, Japan

[21] Appl. No.: 521,388

[22] Filed: May 10, 1990

[30] Foreign Application Priority Data

May 18, 1989 [JP] Japan ..... 1-125227

[51] Int. Cl.[5] ..... F04C 18/04

[52] U.S. Cl. ..... 418/55.2; 418/55.3; 418/179

[58] Field of Search ..... 418/55.2, 55.3, 179; 29/888.022

[56] References Cited

U.S. PATENT DOCUMENTS 4,472,120 9/1984 McCullough ..... 418/55.2

FOREIGN PATENT DOCUMENTS 63-134882 6/1988 Japan .

1-53084 3/1989 Japan ..... 418/55.3

1-80785 3/1989 Japan ..... 418/55.2

*Primary Examiner*—John J. Vrablik

*Attorney, Agent, or Firm*—Antonelli, Terry, Stout & Kraus

[57] ABSTRACT

A scroll compressor having an orbiting scroll member, a stationary scroll member and an Oldham's ring. The stationary scroll member is made of a material having a higher rigidity than the material forming the orbiting scroll member, and a higher density as well as a lower thermal conductivity than any of the materials forming the orbiting scroll member and the Oldham's ring.

2 Claims, 4 Drawing Sheets

SCROLL COMPRESSOR WITH A STATIONARY AND ORBITING MEMBER OF DIFFERENT MATERIAL

BACKGROUND OF THE INVENTION

The present invention generally relates to scroll compressors, and more particularly materials used in scroll compressors from the viewpoint of thermal characteristics.

No prior art scroll compressors, have proposed the use of certain combinations of materials for the stationary scroll member, the orbiting scroll member and the Oldham's ring, with the combinations being determined by taking thermal characteristics into consideration. The nearest prior art proposal closest to the above proposal is disclosed in, for example, Japanese Patent Unexamined Publication No. 1-53084.

This publication discloses the art of varying the combination of the materials used to form the orbiting scroll member and the Oldham's ring, and the variation is effective for reducing the size and weight of the entire scroll compressor and assures improvement in sliding characteristic and sliding durability so as to enhance performance and reliability.

A scroll compressor has the following drawback particularly when the scroll compressor is of the high-pressure vessel type in which the compressor elements are in a high-pressure gas atmosphere for example, an atmosphere formed by the compressed gas to be discharged. Since the stationary scroll member and a frame supporting the member are exposed to a high-temperature, high-pressure atmosphere, conduction of heat through members such as the stationary scroll member and the frame may cause the gas suctioned into the compression chamber to be heated to an increased extent, thereby reducing the volumetric efficiency of the compressor. Furthermore, various members may become deformed due, for example, to the temperature distribution over the members or pressure acting thereon. In such cases, the specific volume of the gas or leakage from the compression chamber may be increased, thereby adversely affecting the performance of the compressor.

SUMMARY OF THE INVENTION

The present invention has been accomplished with the aim of reducing the weight of the movable component parts among the compressor elements, and improving the performance of the compressor, with the performance being improved by suppressing the entrance of heat generated within the compressor into the compression chamber so as to assure less heating of the suctioned gas, and a reduction in the unevenness of the temperature distribution over various members so as to assure less thermal deformation of the members, whereby any increase in the specific volume of the gas or leakage is prevented.

When the stationary scroll member of a scroll compressor is made of a material having a higher rigidity than the material forming the orbiting scroll member, it is possible to make the stationary scroll member less vulnerable to deformation by external pressure. Accordingly, the wrap of the stationary scroll member is deformed by a reduced amount, thereby preventing any large gap or any strong contact at the sealing portion of the scroll members (i.e., on the side surfaces and at the distal ends of the wraps). When the material forming the stationary scroll member also has a lower thermal conductivity than the material forming the orbiting scroll member, even if the outer periphery of the stationary scroll member is maintained in contact with high-temperature gas, it is possible to reduce the amount of heat transferred to the inward portion of the stationary scroll member.

When the orbiting scroll member and the Oldham's ring are each made of a material having a lower density than the material forming the stationary scroll member that is, a material lighter than the stationary scroll member, each of the orbiting scroll member and the ring is subjected to a small inertial load. Furthermore, when the material forming each of these component parts also has a higher thermal conductivity than that forming the stationary scroll member, the orbiting scroll member and the ring are each subjected to less uneven temperature distribution, hence, deformed by a reduced amount.

By virtue of the above-described arrangement, the gas suctioned into the compression chamber is heated only to a small extent, and the specific volume of the gas is increased only by a small amount. Furthermore, the sealing ability of the compressing portion is high, thereby involving only a small leakage from the compression chamber. Still further, since deformation, which may lead to the generation of forcible stress during operation, is avoided, it is possible to reduce contact load and bearing load. Consequently, the compressor is able to operate with a high volumetric efficiency and with a small dynamic loss, and thus exhibits a high level of performance.

If an aluminum alloy is used to form the orbiting scroll member and the Oldham's ring, it is advantageous to use a cast iron material, which is capable of good sliding on an aluminum alloy material, in keyway portions at which the Oldham's ring engages with the orbiting scroll member. This arrangement makes it possible to avoid the risk of wear or seizure.

The above-described arrangement may be adopted together with an arrangement in which a material having a relatively small coefficient of thermal expansion is used to form the stationary scroll member which is subjected to high temperatures during operation, while a material having a relatively high coefficient of thermal expansion is used to form the orbiting scroll member which is subjected to low temperature during operation. With this arrangement, it is possible to maintain the correct gap between the wraps also during operation.

In the compressor according to the present invention, the following can be said when the centrifugal force and the inertial load on the orbiting scroll member and the Oldham's ring are compared with those generated in a conventional scroll compressor of which the stationary scroll member, the orbiting scroll member and the Oldham's ring are each made of an iron material. That is, the inertial load and the centrifugal force on the above-mentioned members are substantially equal to those generated in the conventional compressor when the driving frequency of the motor of the compressor is substantially equal to the product expressed as [the driving frequency in the conventional compressor]×[the density of the stationary scroll member/the density of the orbiting scroll member]. This means that, according to the present invention, the maximum driving frequency of the compressor can be higher than that of the conventional compressor.

According to another aspect of the present invention, during the manufacture of stationary and orbiting scroll members of a scroll compressor, the scroll members are processed at temperatures close to normal temperature so that suitable dimensions and profiles will be achieved at high temperatures during operation.

BRIEF DESCRIPTIONS OF THE DRAWINGS

DESCRIPTION OF THE PREFERRED EMBODIMENT

One embodiment of the present invention will now be described with reference to the drawings.

Figure 3:
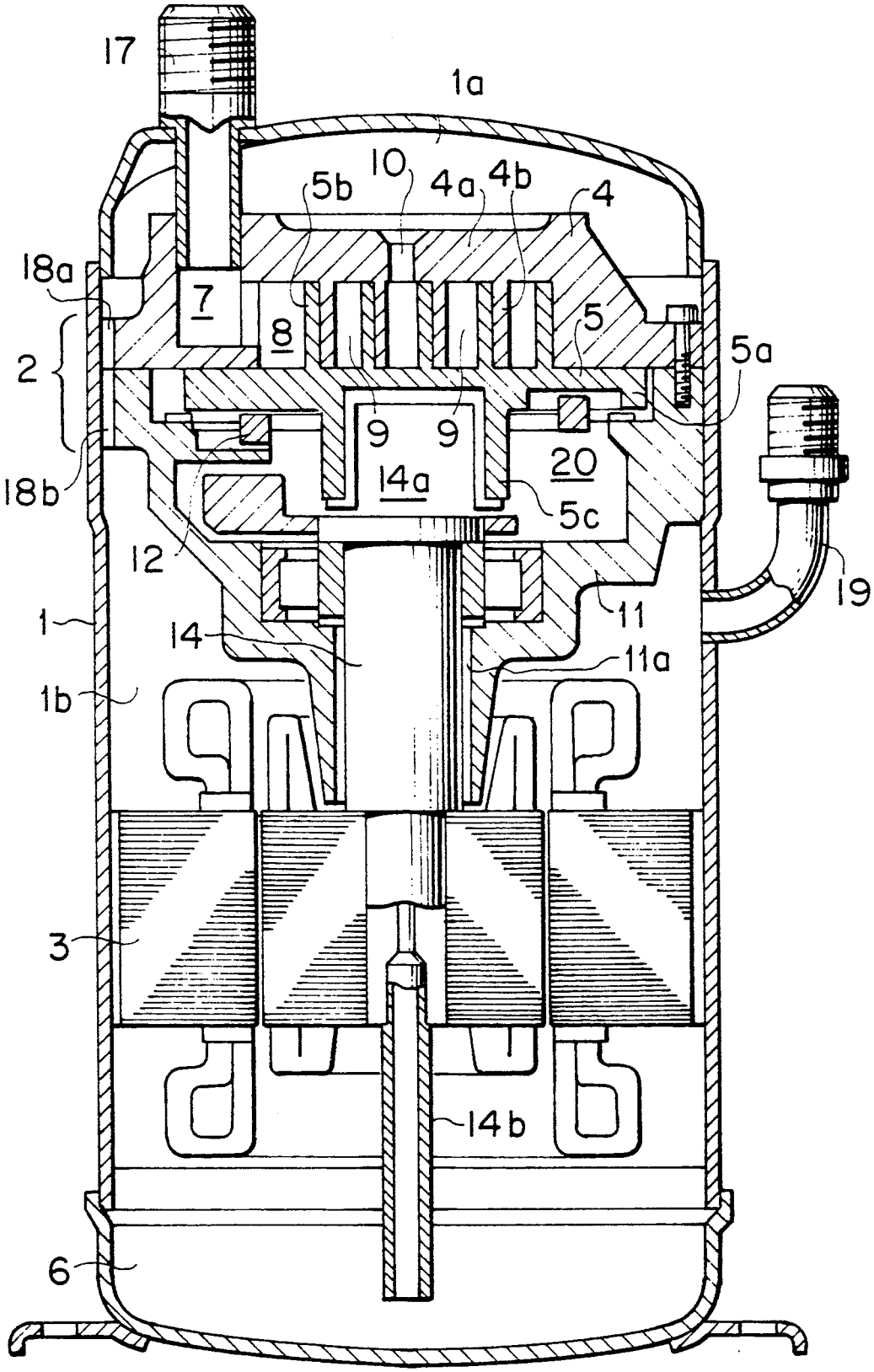
FIG. 3 is a vertical sectional view of a scroll compressor of the embodiment of the compressor.

The scroll compressor shown in FIG. 3 has an enclosing vessel 1 in which a compressor section 2 and a motor section 3 are accommodated. In the compressor section 2, a stationary scroll member 4 and an orbiting scroll member 5 have wraps whose distal ends each extend to and contact with the other scroll member and whose side surfaces face each other to define a plurality of compression chambers 9, with the chambers 9 together forming an enclosed space. The stationary scroll member 4 comprises a disk-shaped end plate 4*a* and a wrap 4*b* normally projecting from the plate 4*a* and formed with an involute curve or a curve approximating an involute curve, and the scroll member 4 has a discharge port 10 in the center thereof and a suction port 7 on the outer periphery thereof which communicates with a suction chamber 8. The orbiting scroll member 5 comprises a disk-shaped end plate 5*a*, a wrap 5*b* normally projecting from the plate 5*a* and formed with the same configuration as the stationary scroll wrap 5*b*, and a boss 5*c*. A center thereof. A rotary shaft 14 is supported by the bearing portion 11*a*, and has an eccentric shaft portion 14*a* positioned at one end thereof and inserted into the boss 5*c* of the scroll member 5 in such a manner as to allow the rotation of the boss 5*c*. The stationary scroll member 4 is fixed to the frame 11 by a plurality of bolts. An Oldham's mechanism comprising an Oldham's ring 12 and an Oldham's key is interposed between the orbiting scroll member 5 and the frame 11 so that the orbiting scroll member 5 is able to perform orbiting motion relative to the stationary scroll member 4 without undergoing autorotation. The other end, the lower end, as viewed in FIG. 3, of the shaft 14 is directly connected to the motor section 3.

The suction port 7 of the stationary scroll member 4 is connected with an inlet pipe 17 which extends through a wall portion of the enclosing vessel 1. The discharge port 10 of the member 4 opens into a discharge chamber la communicating through passages 18*a* and 18*b* with a lower chamber 1*b* which, in turn, communicates with an outlet pipe 19 extending through a wall portion of the vessel 1.

The space surrounded by the frame 11 and the back surface of the orbiting scroll member 5, that is, the surface which is not the surface where the wrap 5*b* is provided, acts as a back pressure chamber 20. In this chamber 20, a pressure of an intermediate magnitude between the suction pressure (pressure on the low pressure side) and the discharge pressure prevails to act against thrusting force generated by the gas pressure within the compression chambers 9 defined by the stationary and orbiting scroll members 4 and 5, which thrusting force acts to downwardly separate the orbiting scroll member 5. The intermediate-magnitude pressure is obtained by forming small bores (not shown) through the end plate 5*a* of the orbiting scroll member 5, introducing part of the gas within the compression chambers 9 to the back pressure chamber 20, and causing the part of the gas to act on the back surface of the orbiting scroll member 5.

In order to supply oil to various bearing portions of the rotary shaft 14 including the eccentric shaft portion 14*a*, oil supply holes (not shown) are formed from an oil supply pipe 14*b* extending from the lower end of the rotary shaft 14 to the upper end face of the eccentric shaft portion 14*a*. A part of the oil supply pipe 14*b* is dipped in a lubricating oil tank 6 at the bottom of the enclosing vessel 1.

When the rotary shaft 14, directly connected to the motor 3, is rotated, this rotation causes the eccentric rotation of the eccentric shaft portion 14*a*. The eccentric rotation causes, through the boss 5*c*, the orbiting scroll member 5 to perform an orbiting motion. The orbiting motion causes the compression chambers 9 to gradually move toward the center, with the volume of the chambers 9 decreasing. A gas at a low temperature and a low pressure is introduced from the inlet pipe 17 through the suction port 7 into the suction chamber 8 on the outer periphery of the stationary scroll member 4. The introduced gas is compressed to have its pressure increased, and the gas is then discharged from the discharge port 10 at the center to the discharge chamber 1*a*. The discharged gas at a high temperature and a high pressure flows through the passages 18*a* and 18*b* into the lower chamber 1*b*, and the gas is then discharged from the outlet pipe 19 to the outside.

According to the present invention, the stationary scroll member 4 and the frame 11 are each made of a material having a higher rigidity and a lower thermal conductivity than the material forming the orbiting scroll member 5. On the other hand, the orbiting scroll member 5 and the Oldham's ring 12 are each made of a material having a lower density (i.e., being lighter) and having a higher thermal conductivity than the material forming the stationary scroll member 4.

Figure 1:
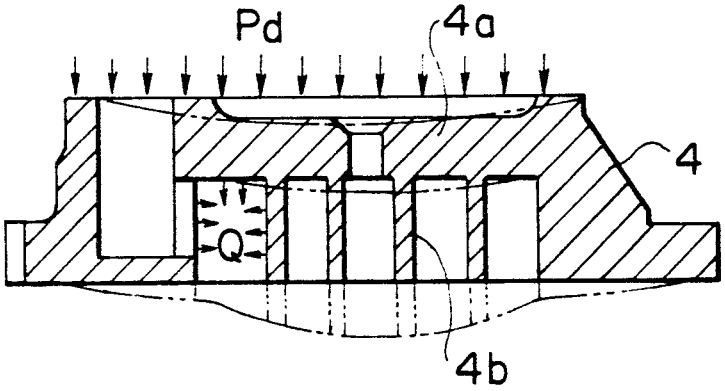
FIG. 1 is a sectional view of a stationary scroll member of an embodiment of a scroll compressor according to the invention.

FIG. 1 shows the deformation of a stationary scroll member 4 during operation. The upper side, as viewed in FIG. 1, of the end plate 4*a* which is not the side where the wrap 4*b* is provided is surrounded by a high-temperature, high-pressure atmosphere formed by the discharge gas. Therefore, due to the difference in pressure between the discharge pressure Pd and the compression pressure, the end plate 4*a* tends to be deformed downwardly as viewed in FIG. 1.

If, in contrast with the present invention, the stationary scroll member 4 is made of a material having a lower rigidity and a higher thermal conductivity than the material forming the orbiting scroll member 5, this is disadvantageous in that the scroll member 4 is deformed by the difference in pressure to a great extent. The deformation is great for the following reasons. Since the temperature distribution is even, it does not cause any thermal stress which may act to suppress deformation. In addition, heat is easily transferred to the compression-chamber-defining portion, thereby involving the risk that the gas suctioned into the compression chambers 9 may be heated by an increased heat amount Q. Furthermore, the temperature at the wrap 4*b* is increased, thereby causing the wrap 4*b* to be thermally expanded by a great degree. Consequently, as indicated by two-dot-chain lines in FIG. 1, the stationary scroll member 4 is greatly deformed downward, with the distal ends of the wrap 4*b* protruding downward. Such a great deformation causes the gap at the sealing portion in the compression chambers 9 (at the distal ends and on the side surfaces of the stationary and orbiting scroll wraps) to become so large as to result in problems such as an increased leakage from the compression chambers 9 (an increased leakage loss) or strong contact of the distal ends of the wraps (an increased friction loss). Another disadvantage is that the temperature of the suctioned gas is increased, thereby increasing the specific volume of the gas. This increase results in a decrease in the amount of gas suctioned from the inlet pipe 17 per unit time, thereby reducing the volumetric efficiency of the compressor.

According to the present invention, the stationary scroll member 4 has a relatively high rigidity and a relatively low thermal conductivity. Therefore, the temperature differs between the lower and upper surfaces of the end plate 4*a*, the upper surface being at a high temperature and the lower surface being at a low temperature. As a result, thermal stress is generated in such a manner that it acts to upwardly deform the end plate 4*a*. This upward deformation serves to offset the deformation caused by the difference in pressure. In addition, heat is not easily transferred to the compression-chamber-defining portion of the stationary scroll member 4, and the wrap 4*b* is at a low temperature and is thermally extended only to a small extent. Consequently, it is possible to prevent the gap at the sealing portion in the compression chambers 9 from becoming too large, and to prevent the distal ends of the wrap from being brought into strong contact, thereby reducing the risk of leakage loss and friction loss. Simultaneously, the gas suctioned into the compression chambers 9 is heated by a small heat amount Q, and, accordingly, the specific volume of the gas increases only slightly, thereby enabling the amount of gas suctioned from the inlet pipe 17 per unit time to remain large and the volumetric efficiency to remain at a high level.

Figure 2A:
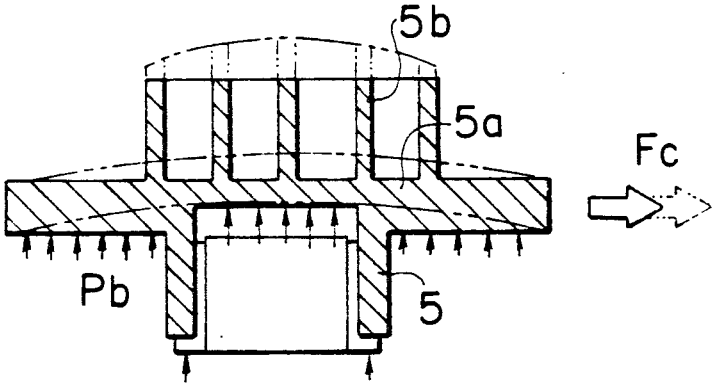
FIG. 2A is a sectional view of an orbiting scroll member of the embodiment of the compressor.
Figure 2B:
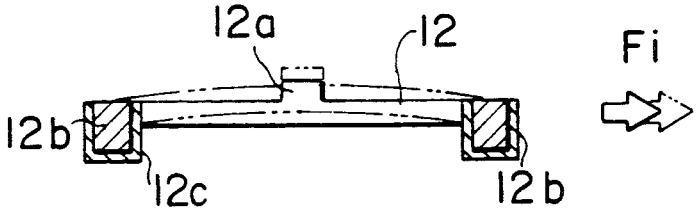
FIG. 2B is a sectional view of an Oldham's ring of the embodiment of the compressor.

FIGS. 2A and 2B respectively show an orbiting scroll member 5 and an Oldman's ring 12 during operation.

If, in contrast with the present invention, the material forming each of the orbiting scroll member 5 and the Oldham's ring 12 is a material having a higher density than the material forming the stationary scroll member 5, this involves the following disadvantage. During operation, the centrifugal force Fc acting on the orbiting scroll member 5 and the force of inertia Fi acting on the Oldham's ring 12 are great. as indicated by arrows drawn in broken lines. The great forces cause an increase in the load on the bearing of the orbiting scroll member 5 and the key of the Oldham's ring 12, thereby leading to an increase in the friction loss and involving the risk of seizure on sliding surfaces. The surface (i.e., the lower surface, as viewed in FIG. 2A) of the orbiting scroll member 5 which is not the surface where the wrap 5*b* is provided is acted upon by the back pressure Pb. Due to the difference between the back pressure Pb and the pressure within the compression chambers 9, the end plate 5*a* tends to be deformed upwardly, as viewed in the drawings. If the material forming the orbiting scroll member 5 also has a lower thermal conductivity than that forming the stationary scroll member 4, since the difference in temperature between the upper and lower surfaces of the end plate 5*a* is large, the member 5 is greatly deformed upward. As a result, the gap at the sealing portion in the compression chambers 9 becomes large, as indicated by two-dot-chain lines in FIG. 2A, and the distal end of the wrap 5*b* is brought into strong contact, thereby leading to increases in the leakage loss and the friction loss. If the material forming the Oldham's ring 12 also has a lower thermal conductivity than that forming the stationary scroll member 4, the frictional heat generated at key portions 12*b* is not sufficiently dissipated, thereby resulting in uneven distribution of temperature over the ring 12. Consequently, the Oldham's ring 12 is deformed upwardly, as indicated by two-dot-chain lines in FIG. 2B. Since the Oldham's ring 12 is mounted with a narrow clearance between the orbiting scroll member 5 and the frame 11, when the ring 12 is greatly deformed, the ring 12 may abut against the lower surface of the end plate 5*a* and the upper surface of the frame 11, thereby involving the risk of an increase in the friction loss or seizure of the end faces of the ring 12. Also, friction between the sliding portions of the orbiting scroll member 5 and the Oldham's ring 12 may cause their temperatures to increase to such a great extent that the lubricating oil is carbonized.

According to the present invention, the material forming each of the orbiting scroll member 5 and the Oldham's ring 12 has a lower density than that forming the stationary scroll member 5. Therefore, during operation, the centrifugal force Fc acting on the orbiting scroll member 5 and the force of inertia Fi acting on the Oldham's ring 12 are small, and, accordingly, the load on the bearing portion and the key is small, thereby involving only a small frictional loss and a low risk of seizure. The material forming each of the orbiting scroll member 5 and the Oldham's ring 12 also has a higher thermal conductivity than that forming the stationary scroll member 4. Therefore, the temperature distribution over each of the component parts 5 and 12 is even, and thermal deformation of the scroll member 5 and the ring 12 occurs only to a small extent, thereby enabling the prevention of such problems as an increase in the gap at the sealing portion (an increase in the leakage loss) and strong contact of the distal ends of the wrap 5*b* or the end faces of the Oldham's ring 12 (an increase in the frictional loss).

According to the present invention, while the orbiting scroll member 5 and the Oldham's ring 12 are each made of a material having a relatively high thermal conductivity, the stationary scroll member 4 coupled with the orbiting scroll member 5 and the frame 11 surrounding the scroll member 5 and the ring 12 are each made of a material having a relatively low thermal conductivity. Therefore, the transfer of heat from the high-temperature gas within the enclosing vessel 1 to the compression-chamber-defining portion occurs only to a small extent, thereby preventing any increase in the heat by which the gas suctioned into the compression chambers 9 is heated. In addition, increase in the temperatures of the sliding portions of the orbiting scroll member 5 and the Oldham's ring 12 occurs only to such a small extent that the lubricating oil is not carbonized.

When the above-specified materials are combined, the scroll compressor is operable with increased volumetric efficiency as well as with reduced leakage loss and friction loss, and the compressor is thus able to provide improved performance. Furthermore, since the load on the sliding portions is small, the risk of seizure is reduced.

Specifically, an FC 25 (cast iron) material may be used to form each of the stationary scroll member 4 and the frame 11, while a high-silicon aluminum alloy may be used to form each of the orbiting scroll member 5 and the Oldham's ring 12. The use of a high-silicon aluminum alloy provides satisfactory strength. If the aluminum alloy contains SiC, the thermal conductivity is increased, whereas if it contains AlN, the workability is improved. The above-described combination is suitable for the achievement of the aim of the present invention.

Figure 4A:
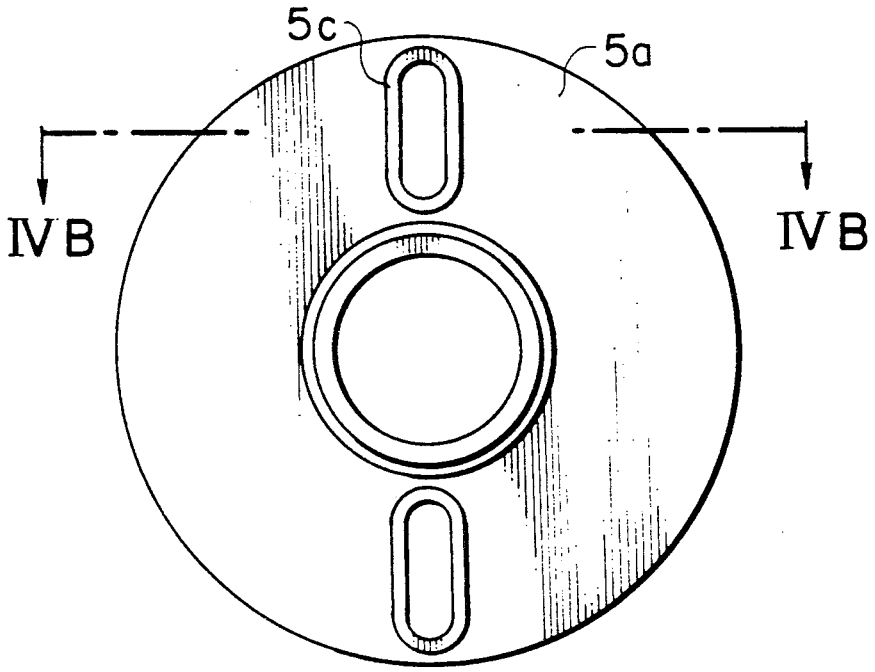
FIG. 4A is a bottom view showing keyway portions of an orbiting scroll member, showing a modification of the embodiment.
Figure 4B:
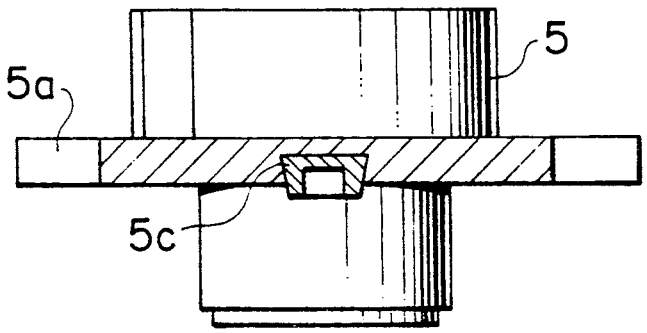
FIG. 4B is a sectional view taken along the line IV-B—IVB shown in FIG. 4A, showing another modification.

If the orbiting scroll member 5 and the Oldham's ring 12 are each formed of an aluminum alloy, the same or similar aluminum materials slide on each other at the portions where the Oldham's key engages with the keyways of the orbiting scroll member 5. This sliding is not preferable from the viewpoint of the resistance against wear. In order to avoid this problem, the foregoing embodiment may be modified as shown in FIGS. 4A and 4B. Specifically, the keyways of the end plate 5*a* of the orbiting scroll member 5 are provided by preparing cast or embedded separate pieces 5C of an FC material or the like in recesses formed in the member 5, and forming keyways in the pieces 5C. With this arrangement, it is possible to avoid the sliding of the same or similar materials, hence, to avoid deterioration in the wear resistance. The modification may alternatively be such that the keyways are provided on the Oldham's ring 12, instead of the orbiting scroll member 5. The Oldham's ring has one of a first cast iron piece having a keyway (5*c* in FIG. 4A) and a second cast iron piece including a key (12*c* in FIG. 2B) to be engaged with the keyway and wherein the orbiting scroll member has another of the first and second cast iron pieces.

Figure 5:
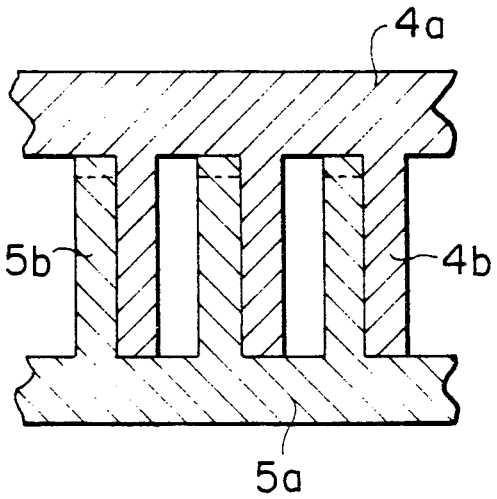
FIG. 5 is a fragmentary sectional view of wraps of stationary and orbiting scroll members, showing their state of being thermally expanded.

FIG. 5 shows another modification directed to a further improvement. In this modification, the stationary scroll member 4 is made of a material which has, in addition to the above-specified properties, a lower coefficient of thermal expansion than the material forming the orbiting scroll member 5, while the orbiting scroll member 5 is made of a material which has, in addition to the above-specified properties, a relatively high coefficient of thermal expansion. Specifically, this requirement is met if the stationary scroll member 4 is made of an FC material while each of the orbiting scroll member 5 and the Oldham's ring 12 is made of a high-silicon aluminum alloy. During operation, the stationary scroll member 4 which is exposed to a high-temperature gas is at high temperatures on the whole, while the orbiting scroll member 5 which is between the stationary scroll member 4 and the frame 11 is at relatively low temperatures. If the materials forming these component parts have the same coefficient of thermal expansion, this is disadvantageous in that, during operation, the orbiting scroll wrap 5*b* is thermally extended to an extent smaller than that to which the stationary scroll wrap 4*b* is thermally extended, thereby resulting in gaps being formed at the distal end of the wrap 5*b*, as indicated by broken lines in FIG. 5. In contrast, with this modification, since the coefficient of thermal expansion differs between the stationary and orbiting scroll members, it is possible to prevent formation of gaps at the distal end of either of the wraps 4*b* and 5*b*, hence, to prevent an increase in the leakage.

Figure 6:
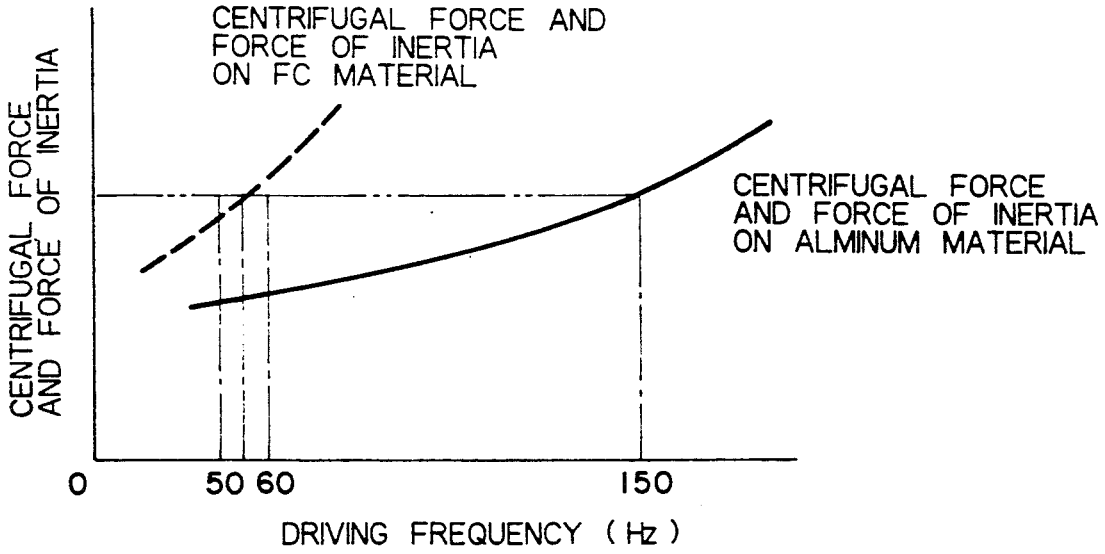
FIG. 6 is a graphical illustration of a difference in load caused by a difference in material.

In the foregoing embodiment and the modifications thereof, the material forming each of the orbiting scroll member 5 and the Oldham's ring 12 has a lower density (i.e., is lighter) than that forming the stationary scroll member 4. Therefore, according to the present invention, in contrast with the conventional arrangement where one or both of these component parts are formed of a material having a density as high as that of the material forming the stationary scroll member 4, the centrifugal force on the orbiting scroll member 5 and the force of inertia on the Oldham's ring 12 are small. Accordingly, it is possible to increase the frequency at which the motor drives the compressor from the conventionally employed driving frequency. This concept will be described with reference to FIG. 6. In the embodiment of the present invention, if, for example, the stationary scroll member 4 is made of an FC material while each of the orbiting scroll member 5 and the Oldham's ring 12 is made of an aluminum alloy material, and the FC material has the density of 7300 kg/m$^3$ while the aluminum alloy material has the density of 2700 kg/m$^3$, when the driving frequency employed in the embodiment of the present invention is substantially equal to the product of the conventional design driving frequency and the ratio between the densities ($7300/2700=2.7$), the centrifugal force and the force of inertia are at the same level as those generated in the conventional arrangement. For example, if the conventional driving frequency is the commercial frequency 50 Hz, the forces are at the same level when the driving frequency in the embodiment of the present invention is 2.7 times greater than 50 Hz or $50\times2.7=135$ Hz. If the conventional driving frequency is the commercial frequency 60 Hz, the forces are at the same level when the driving frequency in the embodiment of the present invention is $60\times2.7=162$ Hz. In this way, in the embodiment of the present invention, when the driving frequency is about 150 Hz, the level of the load generated during operation corresponds to the level of the load generated in the conventional compressor driven by a commercial frequency. On the basis of this concept, the maximum driving frequency in the embodiment of the present invention is expressed as:

$$[\text{The driving frequency in the embodiment}] = [\text{the conventionally achievable driving frequency}] \times \frac{[\text{density of stationary scroll member}]}{[\text{density of orbiting scroll member}]}$$

Next, descriptions will be given on a processing method for the manufacture of the scroll members. According to the present invention, since the stationary scroll member and the orbiting scroll member are made of different materials, and the coefficient of thermal expansion may differ between these members, their relative dimensions at normal temperature differ from those in high-temperature conditions during operation. In order to perform processing in such a manner as to assure that the desired dimensions and specifications will be achieved during operation, dimensions to be achieved by the processing at normal temperature may be calculated during the processing while changes in the relative dimensions, which will possibly be caused by changes in temperature, are taken into consideration. However, this calculation is very complicated. The processing can be most simple if each of the component parts is processed at the same temperature as that during operation. However, the temperatures are too high to be easily adopted during processing. On the other hand, if the following temperatures are selected as the processing temperatures, the adoption of the temperatures, which are relatively close to normal temperature, enables the achievement of the desired dimensions and specifications.

Specifically, the processing temperature $T_{FX}$ at which the stationary scroll member is processed and the processing temperature $T_{OB}$ at which the orbiting scroll member is processed are selected in such a manner as to satisfy the following formula (where $T_{OP}$: standard temperature during operation; $\alpha_{FX}$: coefficient of thermal expansion of stationary scroll member; and $\alpha_{OB}$: co-efficient of thermal expansion of orbiting scroll member):

$$\frac{T_{OP} - T_{OB}}{T_{OP} - T_{FX}} = \frac{\alpha_{FX}}{\alpha_{OB}}$$

With this arrangement, it is possible to select, as the processing temperatures $T_{FX}$ and $T_{OB}$, temperatures which are closer to normal temperature than the temperatures during operation are.

What is claimed is:

1. A scroll compressor comprising:

an enclosing vessel;

a stationary scroll member and an orbiting scroll member, each of said stationary scroll member and said orbiting scroll member including an end plate and a spiral wrap normally projecting from said end plate, said scroll members being disposed in spaced opposition with said wraps therebetween, the distal ends of said wraps contacting the mutually opposing surfaces of said end plates, the side surfaces of said wraps facing each other;

a driving device having a rotary shaft eccentric from the axis of said stationary scroll member and connected to said orbiting scroll member;

an Oldham's ring disposed on the side of said orbiting scroll member remote from said stationary scroll member;

a discharge port disposed in the center of said stationary scroll member and generating discharge gas so as to maintain said enclosing vessel at a discharge pressure; and a back pressure chamber disposed on the side of said orbiting scroll member being remote from said stationary scroll member and being maintained at a pressure of an intermediate magnitude between a suction pressure and said discharge pressure, wherein said stationary scroll member is made of a material having a higher rigidity and a higher density than any of the materials forming said orbiting scroll member and said Oldham's ring, and a lower thermal conductivity and a lower coefficient of thermal expansion than any of the materials forming said orbiting scroll member and said Oldham's ring, wherein said orbiting scroll member and said Oldham's ring is made of a material having a similar coefficient of thermal expansion, thermal conductivity, rigidity and density with respect to each other, and wherein said Oldham's ring has one of a first cast iron portion having a keyway and a second cast iron portion including a key engagable with said keyway and said orbiting scroll member has another of said first and second cast iron portions.

2. A scroll compressor according to claim 1, wherein said stationary scroll member is made of a cast iron material while each of said orbiting scroll member and said Oldham's ring is made of a high-silicon aluminum alloy.

* * * * *